United States Patent [19]

Dardick et al.

[11] Patent Number: 4,831,914

[45] Date of Patent: May 23, 1989

[54] MULTIPLE TIER AMMUNITION MAGAZINE

[76] Inventors: David Dardick, 211 E. 70th St., New York, N.Y. 10022; John Matcovich, 65-15 38 Ave., Woodside, N.Y. 11377

[21] Appl. No.: 71,160

[22] Filed: Jul. 8, 1987

[51] Int. Cl.[4] ..... F41D 10/24

[52] U.S. Cl. ..... 89/33.02; 42/49.01

[58] Field of Search ..... 42/6, 49.01; 89/33.01, 89/33.02, 33.1, 33.16, 33.17, 33.25, 34

[56] References Cited

U.S. PATENT DOCUMENTS

| | | | |
|---|---|---|---|
| 2,865,126 | 12/1958 | Dardick | 42/60 |
| 3,434,380 | 3/1969 | Dardick | 89/13.05 |
| 3,498,178 | 3/1970 | Meyer et al. | 89/33.02 |
| 3,800,658 | 4/1974 | Tassie et al. | 80/33.02 |
| 4,166,408 | 9/1979 | Wetzel et al. | 89/33.02 |
| 4,457,208 | 7/1984 | Golden | 89/33.02 |
| 4,676,137 | 6/1987 | Stockton et al. | 89/33.02 |

FOREIGN PATENT DOCUMENTS

| | | | |
|---|---|---|---|
| 2656710 | 8/1978 | Fed. Rep. of Germany | 89/33.02 |
| 636434 | 5/1983 | Switzerland | 89/33.02 |

*Primary Examiner*—Deborah L. Kyle
*Assistant Examiner*—Richard Klein
*Attorney, Agent, or Firm*—Alfred B. Levine

[57] ABSTRACT

A detachable ammunition magazine for high rate-of-fire guns that stores and positively feeds triangularly shaped cartridges to the gun in serial order. The cartridges are stored in a series of concentric cylindrically shaped tiers or arrays, and are advanced in a spiral path and transferred from one array to another to replace the cartridges fed to the gun. All cartridges are continuously maintained in spiral movement during feeding to the gun and are transfered between tiers using a fixed cam structure.

15 Claims, 3 Drawing Sheets

MULTIPLE TIER AMMUNITION MAGAZINE

STATEMENT OF THE INVENTION

This invention generally relates to ammunition feeding systems for high rate-of-fire guns, and more particularly to improvements in detachable magazines for storing and feeding triangularly shaped cartridges to such guns.

BACKGROUND OF THE INVENTION

In many earlier patents of David Dardick there are disclosed a number of guns and ammunition feed systems characterized by employing triangularly shaped cartridges that are fed, fired, and ejected transversely to the gun without any axial movement of the cartridges. Such weapons offer many advantages over more conventional weaponry including self-alignment of the cartridges within the gun for single and salvo projectile firing configurations, more positive feed of the cartridges with reduced liklihood of jamming, higher rate of ammunition feed capability, and others. Such patents include U.S. Pat. Nos. 2,831,401, 2,847,784, 2,865,126, 2,983,225, 3,041,939, 3,046,890, 3,434,380, 3,446,111, 3,446,113, 3,467,276, 3,486,327, 3,501,998, 3,503,300, 3,507,219, 3,568,599, 3,572,248, 3,601,061, and 3,855,931.

SUMMARY OF THE INVENTION

According to the present invention there is provided an elongated, detachable, ammunition magazine for such weapons for storing and feeding a large number of such triangularly shaped cartridges in a positive manner yet capable of a high rate of feed to the gun.

In a preferred embodiment, all of the cartridges within the magazine are continuously maintained in motion during serial feeding of the cartridges to the gun. They are fed in a spiral path within the magazine in serial order. To more effectively utilize the space within a cylindrically shaped magazine, multiple tiers, or spirals, of such cartridges are provided and the axial direction of feed of the cartridges is reversed at the end of each tier or spiral, to serially feed the cartridges from each tier to the next. A passive mechanism for transferring the cartridges between the tiers reverses the axial direction of the feed.

DETAILED DESCRIPTION OF PREFERRED EMBODIMENTS

Figure 1:
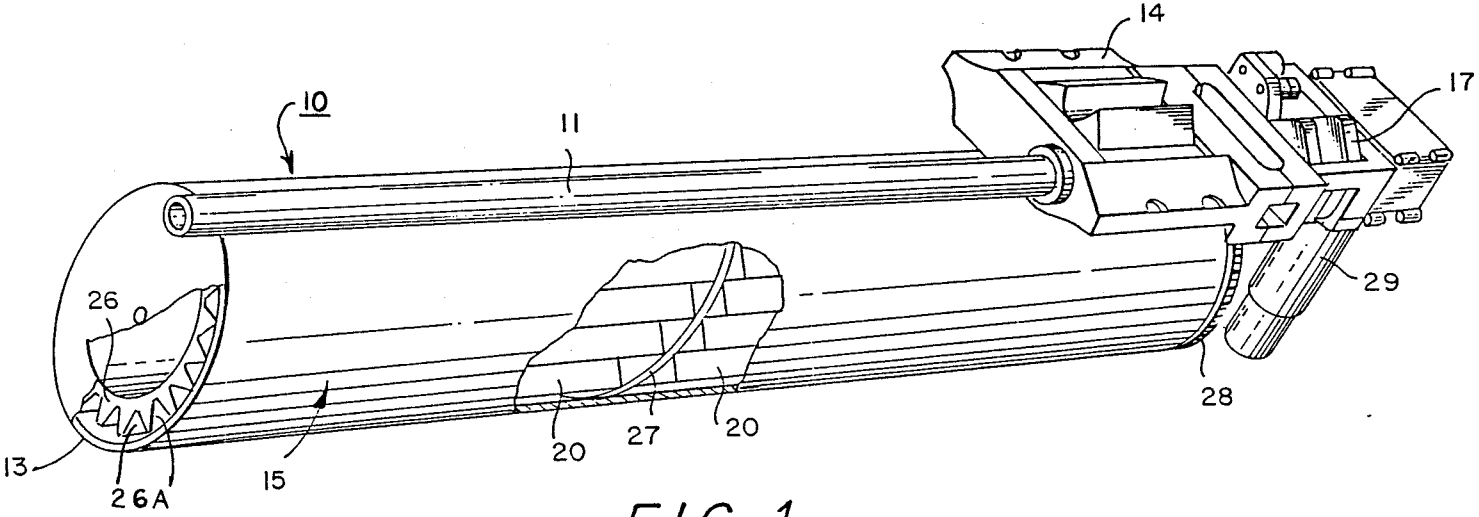
FIG. 1 is a perspective view, with portions cutaway, showing a preferred magazine attached to a high rate-of-fire gun.

Referring to FIG. 1, there is shown a high rate-of-fire gun or cannon 10, according to the invention, having a detachable, elongated, cylindrical magazine 15 coupled to the gun 10 for serially feeding cartridges 20.

Figure 2:
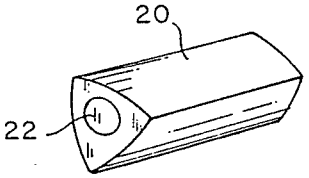
FIG. 2 is a perspective view of a preferred ammunition cartridge.

As shown, the magazine 15 is preferable provided as an elongated, large diameter unit, having a length slightly less than that of the gun barrel 11, to accomodate and feed a maximum number of triangularly shaped cartridges 20, as shown in FIG. 2.

Figure 4:
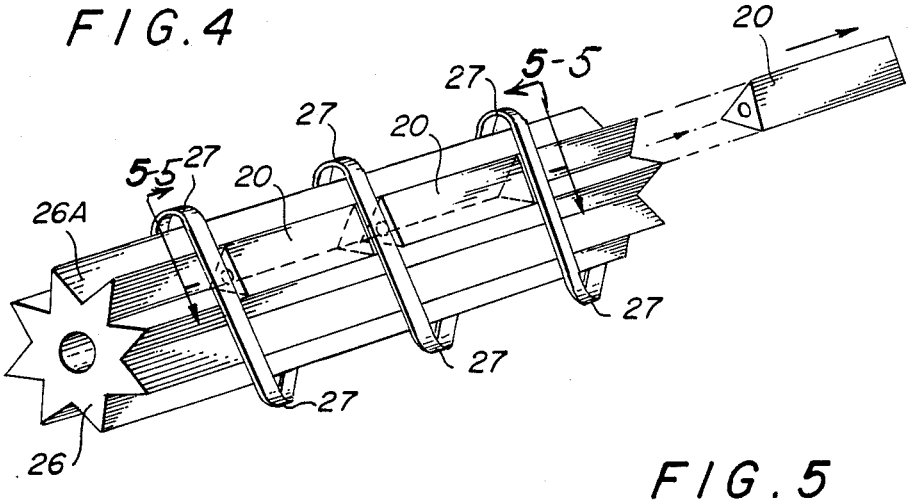
FIG. 4 is a schematic illustration, in perspective view, showing inner drive portions of the magazine for driving the cartridges in a spiral path.

The magazine's outer case 13 is made of thin, yet strong, sheet metal or plastic material, and is suitable clamped, in a detachable fashion ( not shown) to portions of the frame 14 of the gun 10. As shown by the cutaway portion at the left end of the magazine 13, and in greater detail in in FIG. 4, inside of the hollow case 13 is provided an elongated star shaped wheel 26 that is mounted to rotate within the case 13. The rotatable star wheel 26 has a series of triangularly shaped channels 26A along its length, with each of the channels 26A adapted to accomodate a linear stack of the cartridges 20 , end to end, as shown in FIG. 4.

The outside of the cartridges 20 extend beyond the cavities 26A in the star wheel 26 and engage with a spiral ramp 27 that is affixed in position inside of the case 13 of the magazine. As the star wheel 26 is rotated, the cartridges 20 are axially advanced by the fixed ramp 27 , sequentially moving within their channel 26A from the left end of the star wheel 26 to the right end, as illustrated in FIG. 4.

It will be noted that all of he cartridges 20 within the magazine 15 are continuously rotated and axially advanced as the star wheel 26 is rotated within the case 13 of the magazine 15.

Returning to FIG. 1, the inner star wheel 26 is coupled to a spur gear 28 located outside of the magazine 15, and the gear 28 is rotatably driven by an electric motor 29 on the gun. At the right hand end of the magazine 15, there is provided an outlet not shown) in the case 13 that is in communication with a feed wheel 12 on the gun 10. The feed wheel 12 has a series of open sided triangularly shaped cavities 16 that receive each of the triangularly shaped cartridges 20 being sequentially fed from the magazine 15. Each of the cartridges 20 are transversely fed into a different cavity 16 in the feed wheel 12, as the feed wheel 1 is rotated in syncronism with rotation of the star wheel 26, and then rotated by the feed wheel 12 of the gun into the firing chamber (not shown) of the gun for firing.

According to the present invention, the ammunition magazine 15 is provided with multiple tiers or layers of cartridges 20 in order to maximize the number of such cartridges that can be accomodated by a cylindrical magazine of given volume. This is performed by providing an additional one or more storage and feed mechanisms concentrically inside of the first star wheel 25, as best shown in FIG. 5 and FIG. 6.

Figure 6:
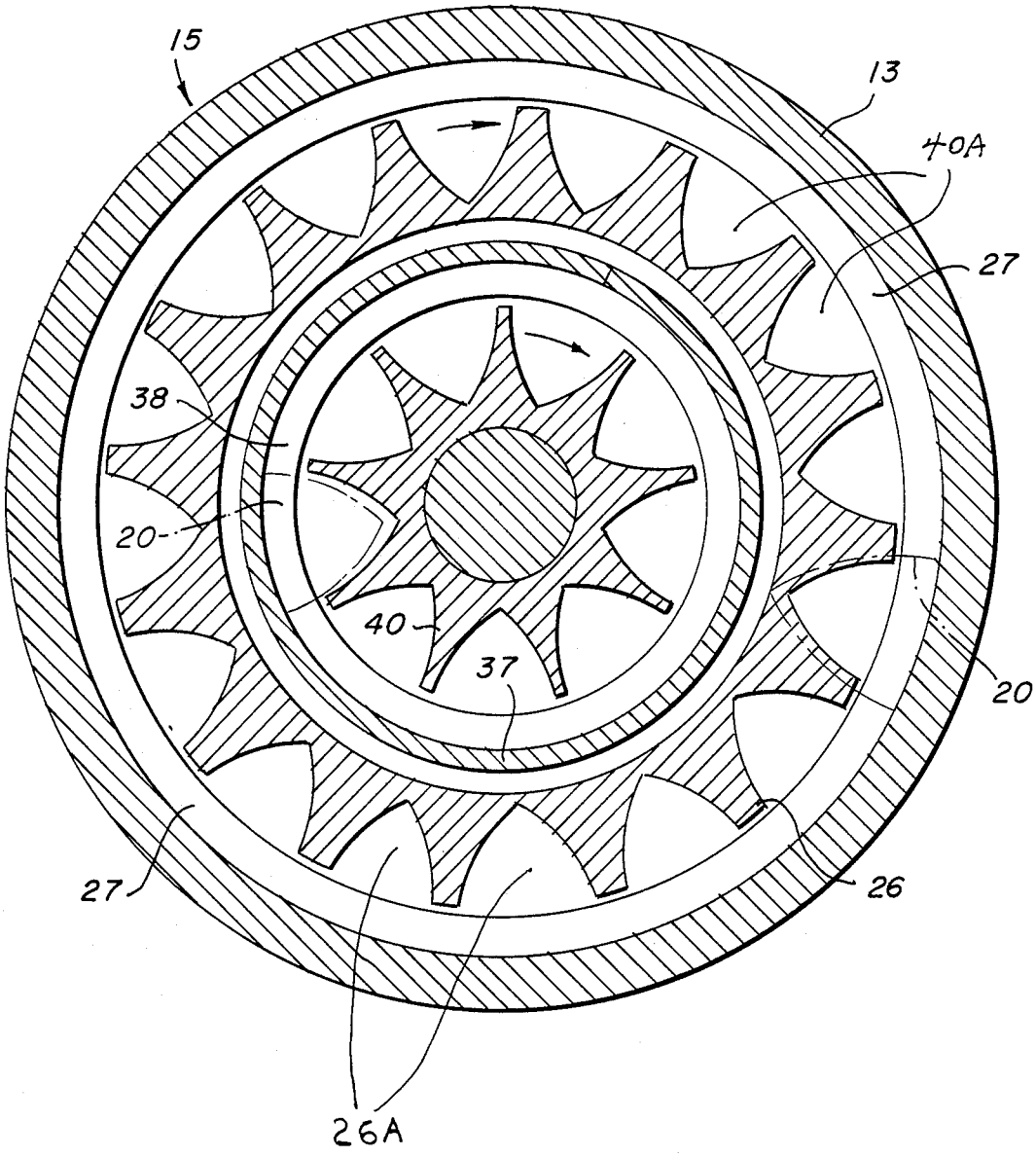
FIG. 6 is a cross sectional view taken along lines 6—6 of FIG. 5.

Initially referring to FIG. 6, the outer star wheel 26, as described above, is formed as a hollow member, and concentrically located inside of this outer star wheel 26 is disposed an inner star wheel 40. The inner star wheel 40 is provided with a lesser number of triangularly shaped channels 40A to accomodate the triangularly shaped cartridges 20, and it independantly rotates inside of the outer star wheel 26. A cylindrically shaped inner housing 37 is fixed in position about the inner star wheel 40, and the inner housing 37 supports an inner spiral ramp 38 that interengages with the ends of the cartridges 20 supported in the channels 40A of the inner star wheel 40. In the same manner as described above, rotation of the inner star wheel 40 results in the cartridges 20 supported on the inner wheel 40 being rotated and concurrently being axially advanced in succession by riding upwardly on the inside ramp 38, to be serially fed to the gun for firing. In overall operation, the inner and outer star wheels 40 and 26, respectively, are rotated in a syncronized manner whereby as each cartridge 20 is fed from the inner star wheel 40 to the gun, it is replaced by a cartridge 20 being fed from the outer star wheel to the inner star wheel 40. In this manner, the entire magazine is emptied of cartridges 20 when all cartridges 20 are serially fed from both star wheels 40 and 26.

Figure 5:
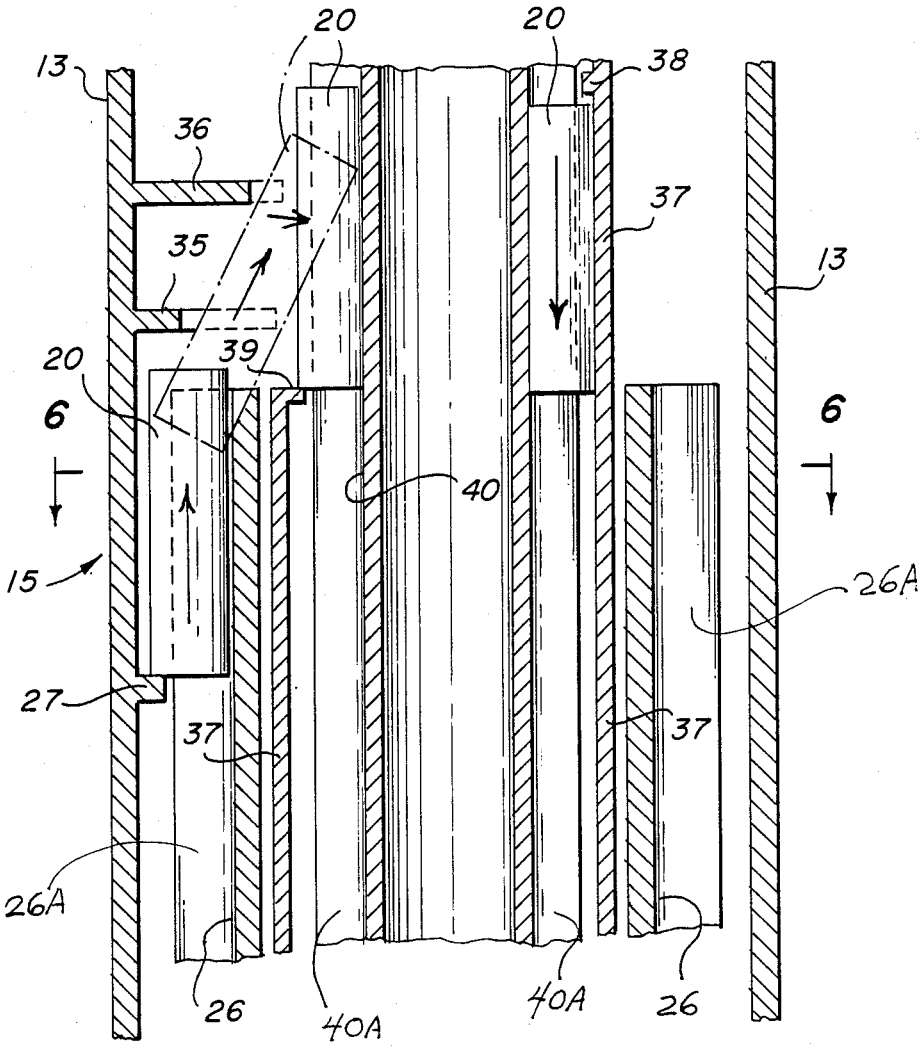
FIG. 5 is a longitudinal section, lengthwise through an ammunition magazine, showing the transfer of cartridges between two tiers.

FIG. 5 illustrates the serial transfer of each of the cartridges 20 from the outer tier or layer to the inner tier or layer as the star wheels 26 and 40 are rotated in a correct syncronized relationship. The magazine 15 is shown positioned vertically in FIG. 5, and the cartridges 20 are illustrated as being axially advanced upwardly as the outer star wheel 26 is rotated; and then advanced downwardly as the inner star wheel 40 is rotated.

As shown, the cartridge 20 at the left is advanced upwardly by engaging with the fixed spiral ramp 27 as the outer star wheel 26 is rotated. When this cartridge 20 reaches a transfer position at the upper left of the magazine 15, the top edge of the cartridge 20 engages the beginning of a progressive inward camed surface 35, that progressively tilts the cartridge 20 inwardly, as shown, at the same time as spiral ramp 27 continues to advance the cartridge in an upward direction. The continued movement upwardly of this cartridge 20 bring its outer surface into engagement with a progressively projecting upper cam 36, and the action of these two cams 35 and 36, taken with the spiral ramp 27 result in the cartridge 20 being radially transferred from the outer star wheel 26 to a cavity 40A on the inner star wheel 40.

The drive ramp 38 confronting the inner star wheel 40 is spirally wound in an opposite direction to that of the outer spiral ramp 27. Therefore as the inner star wheel 40 rotates, the inner ramp 38 drives the cartridge 20 downwardly (in FIG. 5) toward the opposite end of the magazine where it is fed to the gun. Thus the outer star wheel 26 and ramp 27 drive each of the cartridges 20 in sequence upwardly to one end of the magazine 15 where each is progressively engaged by the passive cams 35 and 36 to be transferred to the inner star wheel 40. The rotation of the inner star wheel 40 together with the inner ramp 38 then drives these cartridges in serial order in the opposite direction to the end of the magazine where they are serially fed to the gun. It will be appreciated that more than two tiers or layers of cartridges 20 may be provided by employing additional star wheels and ramps that function in the same manner as described.

Figure 3:
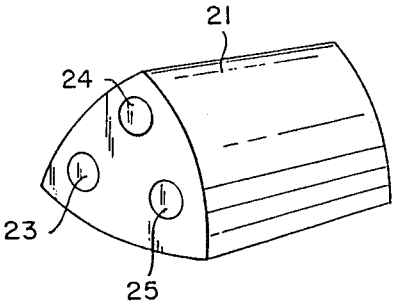
FIG. 3 is a perspective view, similar to FIG. 2, showing a modified cartridge for firing a salvo of projectiles.

Thus the rotation of the outer star wheel 26 interacting with the fixed spiral ramp 27 continuously drives all of the plural rows of cartridges 20 in an upward spiral path, as shown in FIG. 5. As each cartridge 20 reaches the top of the spiral path, near the end of the star wheel 26, it engages with the fixed pair of cams 35 and 36 and is tilted and deflected from its cavity 26A on outer wheel 26 to a cavity 40A on the inner star wheel 40. Concurrently, the syncronized rotation of the inner star wheel 40 continuously drives all of the cartridges 20 supported on the inner wheel 40 in a downward spiral path in FIG. 5. The inner wheel 40 serially feeds each of the cartridges 20 at the bottom of the spiral (not shown in FIG. 5) to the gun 10.

Where the gun is adapted to fire a salvo of the projectiles 23, 24, 25 from a salvo cartridge 21 ( FIG. 3), the construction and operation of the magazine 15 is the same. The gun 10 is modified, however, to fire the salvo, by substituting a gun barrel having three bores (not shown) for firing the three projectiles 23, 24, and 25 of each cartridge 21. As disclosed in the above referred to application, the triangular shape of the cartridge 21, taken with the equal spacing of the projectiles 23, 24, and 25 results in the cartridge 21 being self indexing in the gun to always align each of the three projectiles 23, 24, and 25 with a different one of the three bores in the gun barrel (not shown).

Although only one preferred embodiment of the invention has been disclosed, it will be understood by those skilled in the gun arts, that many changes may be made without departing from the spirit and scope of this invention. Accordingly this invention is to be considered as being limited only by the following claims.

What is claimed is:

1. A detachable ammunition storage and feed magazine comprising:

an elongated rigid hollow housing, an elongated cylindrical rotor supported for rotation inside said housing, said rotor having a series of triangularly shaped channels spaced about its periphery and extending along the length of the rotor, each for supporting a linear array of triangularly shaped cartridges with one side of the cartridges extending outside of the channel, a spirally configured ramp supported inside of the housing and projecting inwardly to engage with portions of the cartridges that extend outside of the channels in the rotor, an inner housing disposed inside of the rotor, an inner rotor supported for rotation inside of the inner housing, an inner ramp supported inside of the inner housing and projecting inwardly toward the inner rotor, said inner rotor having a series of triangularly shaped channels extending along its length , each to support and array of projectiles with a portion of the projectiles engagable with the inner ramp, means for rotating said rotor and inner rotor in a syncronized relationship, and stationary means adapted to serially transfer the cartridges from the channels in the rotor to the channels in the inner rotor when the rotor and inner rotor are rotated.

2. In the magazine of claim 1, said stationary means comprising a cam structure supported inside of the housing near the end of the rotor to serially intercept the cartridges, and in cooperation with the rotating rotor and the ramp to deflect the cartridges from the channel of the rotor to a channel of the inner rotor.

3. In the magazine of claim 1 , said housing being cylindrical in shape and substantially coextensive in length with the barrel of a gun to which it is adapted to be employed.

4. In the magazine of claim 1, the interior of the hollow housing being cylindrical in shape and supporting said spirally configured ramp, the spirals of said ramp being spaced apart corresponding to the length of the cartridges, and all cartridges within said magazine adapted to be in continuous rotative and axial movement as the rotor is rotated.

5. In the magazine of claim 1, said stationary means comprising a pair of progressively projecting cams spaced apart lengthwise inside of the housing near the end of the rotor, said cams pressively projecting inwardly for different rotative positions of the rotor, thereby to progressively deflect the cartridges from a channel of the rotor to a channel of the inner rotor.

6. A cartridge storage and feed magazine comprising:

a housing, a cylindrical rotor within said housing supported for rotation, said rotor having a series of triangularly shaped channels about its periphery for supporting plural rows of triangularly shaped cartridges, a spiral ramp spaced from said rotor and adapted to engage the cartridges and axially advance the cartridges when the rotor is rotated, an inner cylindrical rotor disposed inside of the rotor and supported for rotation, said inner rotor having triangularly shaped channels to support said cartridges, an inner spiral ramp spaced from the inner rotor for axially advancing the cartridges when the inner rotor is rotated, and passive transfer means near the end of the rotor and adapted to engage the axially advancing cartridges from the rotor as the rotor is rotated to transfer the cartridges to the inner rotor.

7. In the magazine of claim 6, said passive transfer means including a cam structure to radially intercept the cartridges and deflect the cartridges inward into a cavity in the inner rotor.

8. In the magazine of claim 6, drive means supported by the housing for rotating the rotor and the inner rotor in a syncronized relationship enabling the transfer of cartridges from cavities in the rotor to corresponding cavities in the inner rotor.

9. In the magazine of claim 6, the spiral ramps for said rotor and for said inner rotor being configured in opposite directions to axially advance the cartridges along the rotor and inner rotor in opposite directions.

10. In the magazine of claim 6, the spiral ramps for said rotor and for said inner rotor being configured in opposite directions to advance the the cartridges in opposite axial directions, an outlet for the inner rotor for serially feeding the cartridges, and said transfer means transferring cartridges from the outer rotor to the inner rotor in syncronism with the feeding of cartridges from the inner rotor.

11. A detachable ammunition storage and feed magazine for triangularly shaped cartridges comprising:

an elongated housing, an elongated cylindrically shaped cartridge support disposed inside of said housing, said cartridge support having a series of spaced apart triangularly shaped cavities along its length, each for supporting a series of triangularly shaped cartridges, a spirally configured ramp spaced about the outside of the cartridge support and adapted to engage portions of the cartridges, drive means for rotating one of the ramp and cartridge support, thereby to both rotate and axially advance all cartridges within the magazine, and cam means adapted to sequentially intercept each of the rotating and axially advancing cartridges near the end of the cartridge support and radially deflect each cartridge out of its cavity in the cartridge support in sequence, an inner cartridge support located coaxially inside of the cartridge support, and having triangularly shaped cavities for supporting said cartridges, and said cam means adapted to deflect each of the cartridges in sequence from its cavity in the cartridge support to a cavity in the inner cartridge support.

12. A detachable ammunition storage and feed magazine for triangularly shaped cartridges comprising:

an elongated housing, an elongated cylindrically shaped cartridge support disposed inside of said housing, said cartridge support having a series of spaced apart triangularly shaped cavities along its length, each supporting a series of triangularly shaped cartridges, a spirally configured ramp spaced about the outside of the cartridge support and adapted to engage portions of the cartridges, drive means for rotating one of the ramp and cartridge support, thereby to both rotate and axially advance all cartridges within the magazine, and cam means adapted to sequentially intercept each of the rotating and axially advancing cartridges near the end of the cartridge support and radially deflect each cartridge out of its cavity in the cartridge support in sequence, an inner cartridge support coaxially located inside of said cartridge support, and a spirally configured ramp spaced about the outside of said inner cartridge support, and said drive means adapted to rotate the cartridge support and the inner cartridge support in a syncronized manner, thereby to rotate and axially advance all cartridges in the magazine.

13. A detachable ammunition storage and feed magazine for triangularly shaped cartridges comprising:

and elongated housing, an elongated cylindrically shaped cartridge support disposed inside of said housing, said cartridge support having a series of spaced apart triangularly shaped cavities along its length, each supporting a series of triangularly shaped cartridges, a spirally configured ramp spaced about the outside of the cartridge support and adapted to engage portions of the cartridges, drive means for rotating one of the ramp and cartridge support, thereby to both rotate and axially advance all cartridges within the magazine, and cam means adapted to sequentially intercept each of the rotating and axially advancing cartridges near the end of the cartridge support and radially deflect each cartridge out of its cavity in the cartridge support in sequence, an inner cartridge support and an inner spirally configured ramp spaced about the outside of the inner cartridge support, said inner cartridge support and said inner ramp disposed coaxially inside of the cartridge support, said drive means adapted to rotate the cartridge support and inner cartridge support in a syncronized relationship to sequentially feed cartridges from the magazine, and said cam means deflecting each cartridge from the cartridge support to the inner cartridge support.

14. A detachable ammunition storage and feed magazine for triangularly shaped cartridges comprising:

first storage and feed means for storing a series of lines of cartridges in a cylindrical array, second means for storing a second series of lines of cartridges in a second cylindrical array disposed coaxially inside of the first cylindrical array, drive means adapted to rotate the first and second storage and feed means in a syncronized relationship, and passive transfer means aligned with said first and second storage and feed means for sequentially transfering each of the cartridges from the first storage and feed means to the second storage and feed means during rotation of the first and second storage and feed means, said first storage and feed means and said second storage and feed means comprising an outer and inner cartridge support, respectively, an outer spirally configured ramp about the outside of said first storage and feed means, and an inner spirally configured ramp spaced about the outside of the inner storage and feed means, and said outer and inner ramps adapted to engage the cartridges on each of said cartridge supports to axially advance the cartridges as the cartridge supports are rotated.

15. A detachable ammunition storage and feed magazine for triangularly shaped cartridges comprising:

first storage and feed means for storing a series of longitudinally arranged lines of cartridges in a cylindrical array, second storage and feed means for storing a second series of longitudinally arranged lines of cartridges in a second cylindrical array disposed coaxially inside of the first cylindrical array, drive means adapted to rotate said first and second storage and feed means in a syncronized relationship, and passive transfer means aligned with said first and second storage and feed means for sequentially transfering each of the cartridges from the first storage and feed means to the second storage and feed means during rotation of the first and second storage and feed means, said first and second storage and feed means comprising elongated star shaped wheels having plural rows of triangularly shaped channels about their peripheries to accomodate plural rows of triangularly shaped cartridges.

* * * * *